US005824347A

United States Patent [19]

Serafini

[11] Patent Number: 5,824,347

[45] Date of Patent: Oct. 20, 1998

[54] CONCRETE FORM LINER

[75] Inventor: Franco Luigi Serafini, Leudelange, Luxembourg

[73] Assignee: E. I. du Pont de Nemours and Company, Wilmington, Del.

[21] Appl. No.: 721,873

[22] Filed: Sep. 27, 1996

[51] Int. Cl.[6] ..... B28B 7/36; E04G 9/10

[52] U.S. Cl. ..... 425/84; 249/113; 249/134; 249/141; 249/189; 264/86

[58] Field of Search ..... 249/113, 134, 249/141, 189; 425/84, 85; 264/86, 87; 405/45; 428/198

[56] References Cited

U.S. PATENT DOCUMENTS

| | | | |
|---|---|---|---|
| 3,169,899 | 2/1965 | Steuber | 428/198 |
| 4,578,301 | 3/1986 | Currie et al. | 428/109 |
| 4,730,805 | 3/1988 | Yokota et al. | 264/86 |
| 4,787,597 | 11/1988 | Yokota et al. | 425/84 |
| 4,815,892 | 3/1989 | Martin | 405/45 |
| 5,124,102 | 6/1992 | Serafini | 264/86 |
| 5,135,692 | 8/1992 | Serafini | 264/86 |
| 5,206,981 | 5/1993 | Serafini | 29/243.57 |
| 5,302,099 | 4/1994 | Serafini | 425/84 |

FOREIGN PATENT DOCUMENTS

| | | | |
|---|---|---|---|
| 0 429 730 A1 | 6/1991 | European Pat. Off. . | |
| 6-220992 | 8/1994 | Japan | 249/113 |
| 2175635 | 12/1986 | United Kingdom | 249/113 |
| 2 297 945 | 8/1996 | United Kingdom . | |

OTHER PUBLICATIONS

Hyun S.Lim, Ernest Mayer, Tyvek for Microfiltration Media, *Fluid/Particle Separation Journal*, 2, No. 1, 17–21, Mar. 1989.

*Primary Examiner*—Patrick Ryan
*Assistant Examiner*—Joseph Leyson

[57] ABSTRACT

A concrete form liner includes a microporous membrane having pores that transmit water, but prevent the passage of particles with a diameter of 2 microns or greater, and a porous sheet having pores in the range of 0.2 microns to 60 microns on one side of the microporous membrane, the porous sheet having an air permeability at least five times greater than that of the microporous membrane. The form liner is permeable to air and water in a concrete mix, but is substantially impermeable to cement particles in the concrete mix. A drainage scrim may be juxtaposed against the side of the microporous membrane opposite the porous sheet.

17 Claims, 2 Drawing Sheets

CONCRETE FORM LINER

FIELD OF THE INVENTION

The present invention relates to form liners that may be used with a concrete form in the manufacture of concrete articles. More particularly, the invention relates to a concrete form liner that facilitates the removal of both air and excess water from setting concrete, but does not permit passage of cement particles.

BACKGROUND OF THE INVENTION

In the manufacture of concrete articles, the concrete is usually cast using a form in which the concrete takes the shape of the form. The wet concrete is poured into or against the concrete form and, upon setting and removal of the form, the newly-exposed concrete surface is a reverse impression of the inner surface of the form. In the case of wooden forms, the concrete takes on the appearance of the wood grain, and in the case of forms involving seamed form members, the concrete shows any seams that have not been sufficiently masked.

In order to facilitate the mixing and pouring of concrete, water may be added in excess of the amount required for hydration. During mixing and pouring of concrete, a given amount of air is trapped in the mass. The air and excess water are useful for rendering the concrete mix flowable which facilitates handling and pouring of the concrete mix. Such concrete mixes are frequently subjected to vibration inside a concrete form in order to better liquefy the mix and accelerate the removal of air and excess water. The excess water, if left undrained, results in concrete having a weakened surface. The air, if not removed, results in surface pores as large as 0.1 to 3 cm, which pores leave an uneven surface open to the effects of dirt and erosion by cycles of freezing and thawing.

Efforts have been made in the past to improve the removal of excess water from a concrete mix. For example, U.S. Pat. No. 5,124,102 (issued to Serafini) discloses a concrete form liner sheet material with small pores that allow excess water and air to pass therethrough but prevent the passage of most cement particles. However, under circumstances of high concrete fluidity, as occurs with concrete compaction by vibration, the substantial flow of air and water passing through a form liner sheet with pores of the size disclosed in U.S. Pat. No. 5,124,102 still tends to carry cement particles into and through the form liner sheet. The sheet material of U.S. Pat. No. 5,124,102 has one side with a pore size distribution within the range of 0.2 microns to 20 microns. This sheet material has been found to retain cement particles if the particles are larger than about 4 to 20 microns. However, at least 70% of the cement particles in a typical concrete mix are smaller than 20 microns, at least 50% of such particles are smaller than 10 microns, and at least 15% of such cement particles are smaller than 4 microns. When a concrete mix is in a highly fluid state, these very fine cement particles pass through a form liner made of the sheet material described in U.S. Pat. No. 5,124,102. The fine cement particles clog the sheet's larger pores and they collect on the backside of the sheet, which prevents further drainage and thereby provides diminished concrete properties (e.g., white spots). When fine concrete particles pass through the sheet from a fluidized concrete and sufficient curing of the concrete takes place, the cured concrete sticks to the concrete form.

The problem of maintaining drainage on the backside of a form liner sheet material after cement particles begin passing through the sheet has been addressed by laminating a drainage scrim to the backside of the sheet material, as disclosed in U.S. Pat. No. 5,302,099 (issued to Serafini). The drainage scrim is laminated to the backside of the porous sheet to both support the sheet and provide a discharge route for quick passage of water and air, as may be generated during vibration of the concrete form. However, the addition of a drainage scrim does not solve the problem of concrete particles passing through the liner and depositing on the form, making frequent cleanings of the form necessary.

Form liner sheet materials with pores smaller than the 0.2 to 20 micron pore size distribution disclosed in U.S. Pat. No. 5,124,102 and 5,302,099, have been considered. However, such microporous sheets have been found to block the passage of air and/or water through the form liner, especially when the air and water are rapidly emitted from the concrete as occurs during compaction by vibration. The air is trapped in the surface of the concrete where it leaves harmful air pockets and hinders the complete discharge of excess water.

What is needed is an improved concrete form liner that does not permit passage of fine concrete particles, even when the concrete mix is highly fluidized or is subjected to very high levels of compaction by vibration. The improved form liner should facilitate rapid drainage of both air and excess water from the concrete surface but should prevent substantially all concrete particles from passing through the form liner. Preferably, the form liner should be usable without independent form liner tensioning.

SUMMARY OF THE INVENTION

In accordance with the invention, there is provided an improved concrete form liner. The form liner comprises a microporous membrane having pores that transmit at least 1 liter of water per square meter of the membrane during 30 minutes when the water is under a hydrostatic head of 1 cm, but which pores prevent the passage of at least 99% of particles with a diameter of 2 microns or greater suspended in water under a hydrostatic head of 150 cm; and a porous sheet juxtaposed with a first side of said microporous membrane, the porous sheet having at least one layer of pores 95% of which have a diameter in the range of 0.2 microns to 60 microns, which layer is coextensive with the porous sheet, the porous sheet having an air permeability at least five times greater than the air permeability of microporous membrane, when measured at a pressure of 500 Pa. The concrete form liner is permeable to air and water in a concrete mix, but is substantially impermeable to particles in the concrete mix that are of at least 2 microns in diameter. The form liner may further comprise a drainage scrim juxtaposed with a second side of the microporous sheet opposite the first side, the drainage scrim increasing the draining effect of the form liner, the drainage scrim having a thickness of at least 1 mm, and at least 30% open space.

The microporous membrane is preferably a microporous nonwoven sheet that is either hydrophilic by nature or has been treated with a surfactant so as to make the membrane hydrophilic. The preferred material for the microporous membrane is a sheet of thermally bonded fibers of flash-spun polyethylene that have been treated with a surfactant.

The porous sheet of the form liner preferably has at least one layer with a pore size distribution between 0.2 microns to 20 microns. The porous sheet may comprise a layer of porous polymer material applied to the first side of the microporous membrane, or a woven fabric or a nonwoven fabric, such as a thermobonded polyolefin sheet material. Preferably, the porous sheet is laminated to the microporous membrane. It is further preferred that the drainage scrim be laminated to the side of the microporous membrane opposite the porous sheet. The drainage scrim should have sufficient stiffness such that a 2 cm wide strip of the form liner, hanging free over a length of 15 cm, will need a weight of at least 15 grams, placed at 2 mm from the free edge of the form liner, to bend the form liner so as to form an angle of 41 degrees with the plane on which the remainder of the strip is resting within 30 seconds.

BRIEF DESCRIPTION OF THE DRAWINGS

The invention will be better understood with reference to the following figures.

DETAILED DESCRIPTION OF THE PREFERRED EMBODIMENTS

Figure 1:
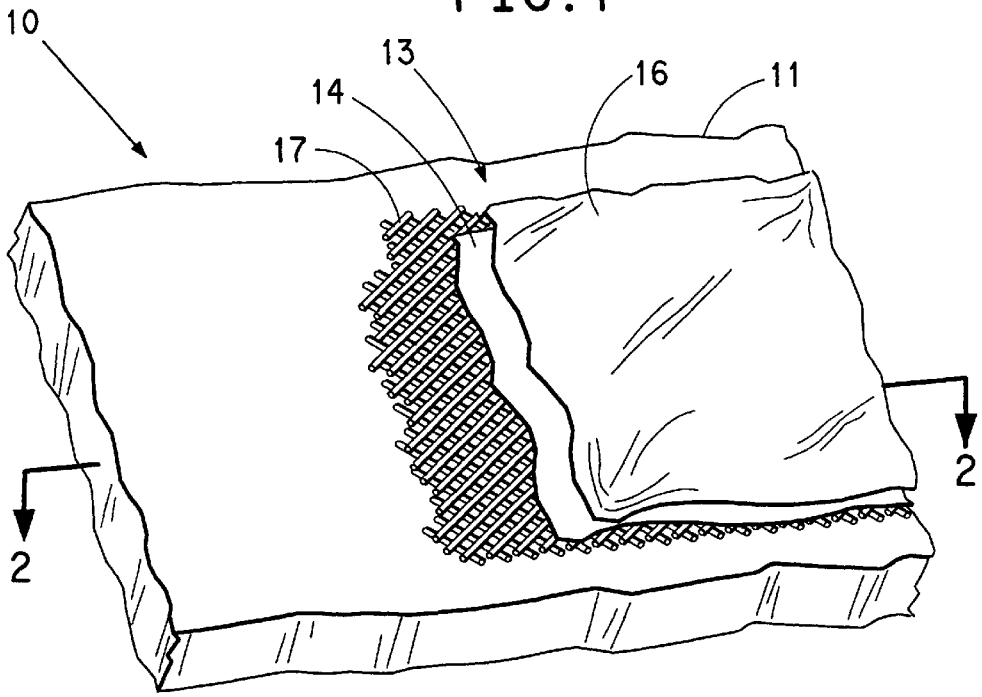
FIG. 1 is a representation of a concrete form, in partial section, with a support and a form liner according to the preferred embodiment of the invention.

Referring now to the figures, wherein like reference numerals represent like elements, FIG. 1 shows a concrete form 10 including support 11 which can be of any material which has been traditionally used as a material for concrete forms. Support 11 must have enough strength to support the weight of the wet concrete before curing. The support can be made of wood or it can be made of metal or plastic, and it should be relatively smooth and flat. In addition, the support may have holes therethrough in order to assist in draining excess water from the concrete surface (see FIG. 4 for detail).

Form liner 13 is comprised of a microporous membrane 14 having a porous sheet 16 juxtaposed against one side thereof. A drainage scrim 17 may be juxtaposed against the opposite side of microporous membrane 14. The word "juxtaposed", as used in this application, means that the faces of juxtaposed members are placed against each other, but that the surface of one face is not necessarily bound to the surface of the other. Preferably, porous sheet 16 and drainage scrim 17 are each laminated to the microporous membrane 14. The microporous membrane 14 must be permeable to air and water, but it must also have a structure that in a filtration test will block passage of at least 99% of particles with diameters larger than 2 microns, where the particles are suspended in water and are under a hydrostatic head of 150 cm. The pores of the microporous membrane may prevent the passage of 99% of particles with a diameter larger than 0.3 microns that are in water under a hydrostatic head of 150 cm. Membrane 14 should be hydrophilic across its cross section so as to make it permeable to water and air. Membrane 14 should be capable of evacuating one liter of water per square meter during a 30 minute period when the water is under a hydrostatic head of about 1 cm. Membrane 14 is preferably made of a lightweight and flexible material that does not degrade in the presence of moisture. Membrane 14 may comprise a microporous film or a woven or non-woven sheet of very low denier fibers such as meltblown fibers or flash-spun fibers.

Nonwoven sheets of bonded flash-spun polymer fibers treated with a surfactant have been found to perform well as the microporous membrane material in the form liner of the invention. Particularly well suited for the membrane material of the form liner of the invention are sheets of spunbonded non-woven polyolefin film-fibrils of the type disclosed in U.S. Pat. No. 3,169,899. A commercial spunbonded non-woven polyethylene film-fibril sheet product that is particularly suitable as the membrane layer of the laminated form liner of the invention is the spunbonded polyolefin sheet sold by E. I. du Pont de Nemours and Company of Wilmington, Del. under the name TYVEK®. TYVEK® is a registered trademark of DuPont. TYVEK® spunbonded polyolefin sheets are lightweight, flexible, and strong. TYVEK® sheets also do not rot in the presence of moisture.

Most microporous sheet materials will require treatment with a surfactant in order to make the sheet sufficiently hydrophilic to serve as the air and water permeable membrane of the form liner of the invention. Spunbonded polyethylene sheets may be treated with a surfactant, such as polyoxyethylene laurate sold by Imperial Chemical Company, PLC of London, United Kingdom ("ICI"), to make the sheet sufficiently water permeable to function as the membrane of the concrete form liner of the invention. Other commercial liquid surfactants or soaps, such as Palmolive Lemon sold by Colgate-Palmolive of New York City, U.S.A., or St. Marc cleaner sold by Benckise NV of Vilforde, Belgium, have also been found to make a microporous sheet sufficiently hydrophilic to perform adequately in the form liner of the invention. The surfactant may be applied directly to membrane 14 before the membrane is laminated to the porous sheet 16 and drainage scrim 17, or the surfactant may be applied directly to membrane 14 through the drainage scrim 17. Alternatively, the surfactant may be applied to the exposed side of the porous sheet 16 (the side that will face the concrete) after the porous sheet 16 is juxtaposed with microporous layer 14 from which point the surfactant migrates through the porous sheet 16 and into the membrane 14 where the surfactant dries. Preferably, about 1 gram of surfactant is applied to each square meter of the microporous membrane. The surfactant should be one that will remain substantially in place in the microporous membrane where the surfactant will continue to facilitate the passage of air and water through the membrane.

A particularly preferred sheet product for use in the invention is TYVEK® Style 1060B bonded sheet material treated with 0.5 to 2.0 g/m$^2$ of polyoxyethylene laurate. TYVEK® Style 1060B bonded sheet material exhibits the strength, flexibility and very fine pore size that make it perform well as the membrane of the concrete form liner of the invention. TYVEK® Style 1060B bonded sheet material has a thickness of between 90 and 300 microns, and a basis weight of about 61 g/m$^2$. A sample of TYVEK® 1060B was treated with 1.0 g/m$^2$ of Hydrophilic Finish G-2109 from ICI, and was allowed to dry. The round sample of the material, having a diameter of 11 cm, was placed in a hydrostatic head tester manufactured by Karl Schroeder, KG of Weinheim, Germany. One side of the sample was contacted with water, at room temperature, under a hydrostatic head pressure of 1 cm. Under these conditions, 1.0 liter/m$^2$ of water passed through the TYVEK® sheet in 10 seconds. TYVEK® sheet, treated with Hydrophilic Finish G-2109, as described above, has an air permeability of 0.06 m$^3$/m$^2$/min at a pressure of 98 Pa, 0.46 m$^3$/m$^2$/min at a pressure of 500 Pa, and 0.75 m$^3$/m$^2$/min at a pressure of 1000 Pa. The very fine pore size of spunbonded polyethylene sheet, such as TYVEK® style 1060B, permits the sheet to retain at least 99% of 0.3 micron particles in a fluid environment, when tested according to the AC Fine Test Dust Testing Procedure (See Lim & Mayer, Tyvek® for Microfiltration Media, Fluid/Particle Separation Journal, Vol. 2, No. 1, at p. 19 (Mar. 10, 1989). The tensile strength for TYVEK® Style 1060B is between 46 and 80 Newtons/cm. In addition, Tyvek® style 1060B sheet material can be washed repeatedly.

Porous sheet 16 of the concrete form liner of the invention may be a woven or nonwoven layer made from natural or synthetic materials. Porous sheet 16 is juxtaposed with the side of membrane 14 that will face away from the concrete form and toward the poured concrete. Preferably, porous sheet 16 is laminated to membrane 14. Alternatively, porous sheet 16 may be a layer of porous material applied directly on membrane 14. Porous sheet 16 functions to prevent grout and larger cement particles from reaching the membrane 14. Porous sheet 16 should be relatively thin, it should be strong enough to withstand repeated uses in a concrete form, it should be water permeable, and it should have small pores, 95% of which have diameters between 0.2 microns and 60 microns. The porous sheet 16 has an average pore size that is significantly larger than the average pore size of the membrane 14 such that the porous sheet 16 has an air permeability at least five times greater than the air permeability of the microporous membrane 14.

The porous sheet 16 also serves to break up air bubbles into smaller units to help overcome capillary resistance to passage of air and water through the membrane 14. During concrete vibration, air bubbles trapped in the fresh concrete are pushed into the relatively large pores of porous sheet 16. As the air bubbles and water pass through sheet 16, the air bubbles are split into smaller bubbles. By the time the air bubbles reach membrane 14 through small channels in porous sheet 16, the bubbles are small enough that the pressure in the concrete mix will be sufficient to force the air through the much finer capillaries of the membrane 14. Indeed, without the porous sheet 16 and the surfactant, the fine capillaries of membrane 14 will prevent passage of both water and the air bubbles through membrane 14 during vibration (see Examples 3 and 7 of Table I). This is because the resistance of capillary forces at the surface of membrane 14 is high. The addition of surfactant to the membrane allows the water to pass, but air is still retained in the concrete in the absence of porous sheet 16 (see Example 4, 8 of Table I).

The preferred material for the porous sheet 16 is a thermobonded polyolefin sheet material, such as polyethylene or polypropylene, having a basis weight of from about 70 to 600 g/m$^2$. However, other polymers can be used for the porous sheet 16, such as PVC, polyester or any other polymer with sufficient chemical resistance for use in the environment of a highly fluid concrete. Preferably, the porous sheet 16 is treated or made in such a way that the side that will face the concrete held within the form liner has pores with a pore size distribution in the range of 0.2 to 20 microns, and preferably between 0.5 to 10 microns. The pores in the porous sheet 16 permit the passage of water and air, but prevent the passage of most of the grout and cement particles in the mix. The sheet must have an adequate compression strength to withstand the high compaction pressures brought against it by the wet concrete. It is preferred that the porous sheet 16 should be at least 0.5 mm thick.

Particularly preferred porous sheets useful in the invention are thermobonded polypropylene sheets as disclosed in U.S. Pat. Nos. 5,135,692 and 5,124,102. The porous sheet 16 may be as disclosed in U.S. Pat. No. 5,135,692 (pores sizes between 10 and 300 microns), or it may be of special construction as disclosed in U.S. Pat. No. 5,124,102 (pores on side facing concrete between 0.2 and 20 microns), the entire contents of each patent being incorporated herein by reference. Preferably, the nonwoven sheet material of U.S. Pat. No. 5,124,102 is used as the porous sheet 16, in which substantially all of the pores on the side of the porous sheet that face the concrete are between 0.2 and 20 microns and the pores on the side of sheet 16 that face the membrane 14 are larger than the pores on the exposed side of sheet 16 and are within the range of 10 to 250 microns. The nonwoven sheet material of U.S. Pat. No. 5,124,102 has an air permeability of 1.8 m$^3$/m$^2$/min at a pressure of 98 Pa, 9.3 m$^3$/m$^2$/min at a pressure of 500 Pa, and 15.8 m$^3$/m$^2$/min at a pressure of 1000 Pa. Such sheet material is commercially available under the trademark ZEMDRAIN® from E. I. du Pont de Nemours, S.A., Luxembourg. ZEMDRAIN® is a registered trademark of E. I. du Pont de Nemours and Company, of Wilmington, Del., U.S.A.

Figure 2:
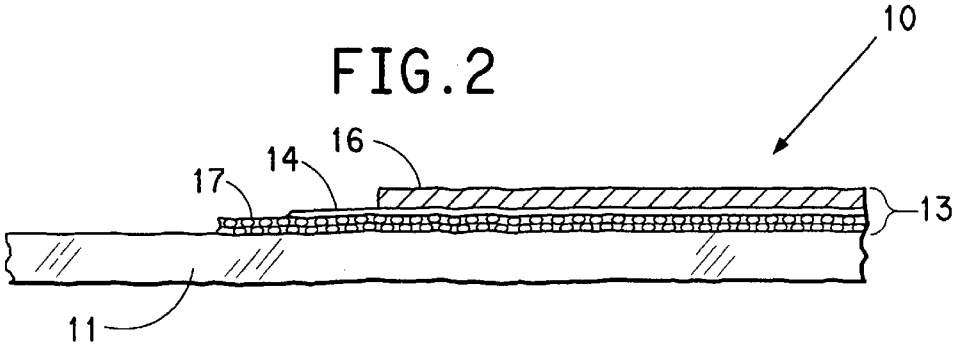
FIG. 2 is a cross-sectional view of the form and form liner of FIG. 1.
Figure 3:
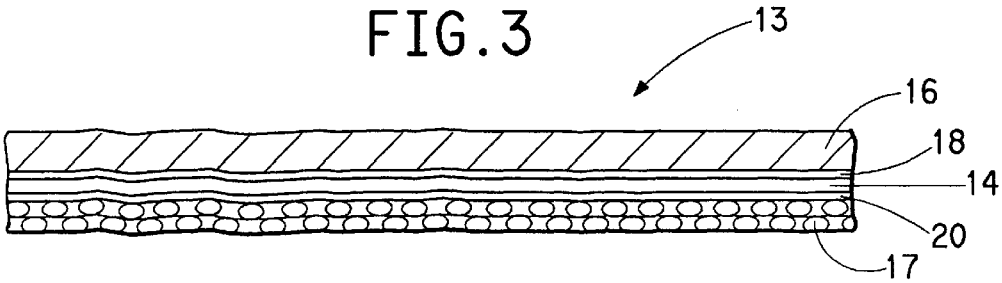
FIG. 3 is a cross-sectional view of the form liner illustrating the porous sheet, the microporous membrane, and the drainage scrim laminated by an adhesive.

Lamination of porous sheet 16 to membrane 14 can take place by extruding the porous sheet 16 directly onto the membrane 14, or by thermally bonding sheet 16 and membrane 14, as shown in FIG. 2. Alternatively, suitable adhesives or hot melts, as are known to those skilled in the lamination art, may be used to adhere porous sheet 16 to membrane 14. In the embodiment of the invention shown in FIG. 3, the adhesive is shown as the layer 18. When an adhesive is used to join porous sheet 16 and membrane 14, the adhesive is applied in a discrete and discontinuous pattern (e.g., dots, lines, swirls) so as to maintain a sufficient area with open pores.

In the form liner of the invention, a drainage scrim 17 may be juxtaposed against the side of the membrane 14 that faces the form liner. Drainage scrim 17 is a mesh or netted structure having a thickness of between 1 mm and 6 mm, and preferably at least 2 mm. Scrim 17 should be non-compressible at a pressure of less than 2 megabars. The netting of the drainage scrim 17 should have between 30% and 90% open space to provide for drainage (e.g., large openings formed by thick filaments or polymer branches). Preferably, the drainage scrim has multi-directional, or at least bi-directional, drainage channels with at least 0.2 mm uncompressed free space between channels available for water to pass through during drainage. Preferably, the scrim netting has a basis weight of between 200 and 2000 g/m$^2$ and is fabricated of a polyolefin material, such as polyethylene or polypropylene.

Suitable drainage scrims 17 for use in the invention are commercially available under the tradename "TENSAR" from Netlon Limited of Blackburn, England. A particularly preferred drainage scrim is disclosed in U.S. Pat. No. 4,815,892, in which the scrim is referred to as a "drainage core." The entire contents of U.S. Pat. No. 4,815,892 are incorporated herein by reference. The drainage scrim 17 can be laminated directly onto the membrane 14. Lamination may be accomplished by thermal bonding (FIG. 2) or by application of an adhesive layer 20 on scrim 17 such that the scrim adheres to membrane 14 (FIG. 3), as is known in the art. One adhesive that has functioned well in adhering scrim 17 to membrane 14 is perforated XIRO Hotmelt Film Type V535 or 2311, from Sarnatech XIRO of Schnitten, Switzerland. Alternatively, the drainage scrim 17 and membrane 14 can be juxtaposed without being adhered to each other. However, in such case the membrane 14 and porous sheet 16 require independent tensioning, as disclosed in U.S. Pat. No. 5,135,692.

Referring now to FIG. 2, concrete form 10 is made by establishing a support 11 with the shape desired for a concrete article, and then juxtaposing form liner 13 against the support. If the drainage scrim 17 is attached to the membrane 14 and porous sheet 16, the form liner 13 can be used without independent tensioning. Such a form liner should have a sufficient stiffness such that a 2 cm wide strip of the form liner, hanging free over a length of 15 cm, will need a weight of at least 15 grams, placed at 2 mm from the free edge of the form liner, to bend the form liner so as to form an angle of 41 degrees with the plane on which the remainder of the strip is resting within 30 seconds. The form liner 13 is positioned such that the exposed side of porous fabric 16 contacts the concrete and the exposed side of drainage scrim 17 contacts the support. The form liner 13 should not be closely affixed to support 11, but should instead be merely juxtaposed therewith. This can be effectively accomplished by using staples or small nails placed periodically at relatively large distances along the edge of the form. It has been determined that the form liner should not be closely attached or bonded to the surface of the support. In use, water will pass through form liner 13 by being drawn away from the concrete surface and passing through the porous fabric 16, the microporous membrane 14, and then through the channels of drainage scrim 17.

Figure 4:
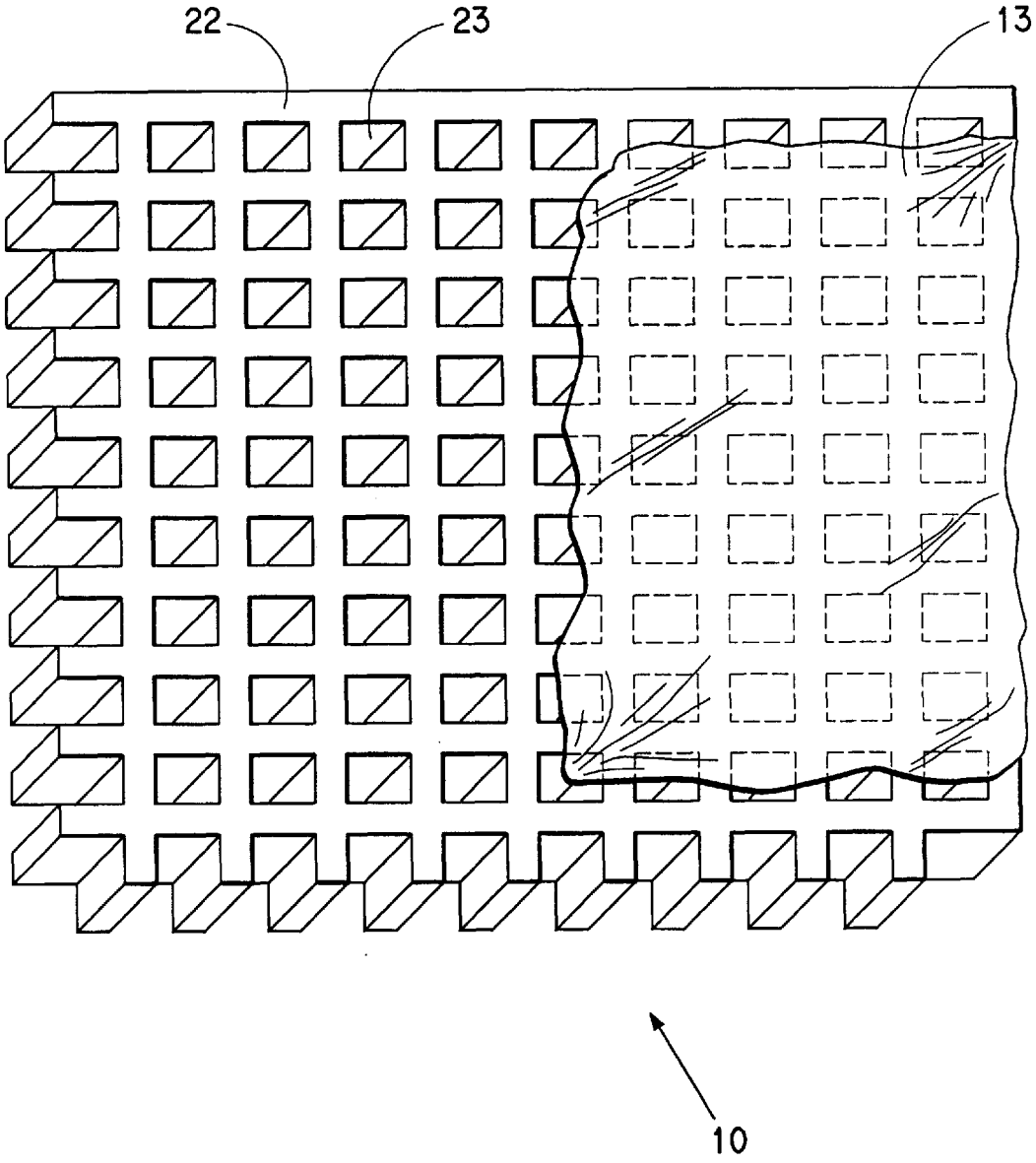
FIG. 4 is a representation of another form, in partial section, with a support having holes juxtaposed with the form liner of the invention.

Referring now to FIG. 4, concrete form 10 may include support 22 with holes 23. (This demonstrates that it is also possible to practice the invention by using a support that has holes in addition to a flat smooth support.) The holes in support 22 should be deep enough to assist the drainage scrim in the drainage of water from the concrete mix and preferably extend through the thickness of the support. The holes can be of any regular or irregular shape or size, and should be greater than about 0.25 $cm^2$ and less than about 2500 $cm^2$. In this embodiment, form liner 13 is juxtaposed with support 22 just as it was with support 11 shown in FIG. 1. It is anticipated that when the form liner is used with a form having enhanced drainage capacity, as shown in FIG. 4, inclusion of the drainage scrim 17 in the form liner may not be necessary.

The improved form liner exhibits many advantages over the prior art. Specific advantages of the inventive form liner over form liners of the prior art include the following:

(1) The form liner of the invention is less sensitive to work site conditions (e.g., concrete too fluid, excessive or irregular vibration or form work vibration).

(2) Both water and air can be removed, even during periods of high concrete fluidity arising from local or overall high energy vibration of the concrete.

(3) Substantially no cement passes through the form liner such that cement is not deposited on the concrete form and cleaning of the form is no longer required.

(4) The retention of cement inside the form liner improves the surface properties of the concrete.

As an added benefit, concrete surface damaging oils or wood sugars on the form are less likely to migrate back through the form liner of the invention than prior art form liners. Finally, the form liner's enhanced ability to remove water from the concrete mix makes it possible to remove the concrete form sooner after pouring the concrete than was possible with forms of the prior art. When a 100 cm high slab is made using the form liner of the invention, with a concrete mix made according to the proportions used in the standard concrete mix of the examples below, and with the addition of sufficient fluidizer to achieve a slump of 100 mm, less than 10 $g/m^2$ of fine cement pass through the form liner, even when subjected to standard formwork vibration conditions for 60 seconds.

EXAMPLES

The concrete form liner of the invention will be further described and will be compared to form liners of the prior art in the following non-limiting examples. All percentages are by weight unless otherwise indicated.

TEST METHODS

In the description above and in the non-limiting examples that follow, the following test methods were employed to determine various reported characteristics and properties. ASTM refers to the American Society of Testing materials.

Basis weight was determined by ASTM D-3776-85, which is hereby incorporated by reference, and is reported in $g/m^2$.

Thickness was determined by ASTM D 1777-64, which is hereby incorporated by reference, at a pressure of 0.05 bar and is reported in millimeters.

Tensile strength was determined by ASTM D 1682, Section 19, which is hereby incorporated by reference, and is reported in N/cm.

Hydrostatic head measures the resistance of a sheet to the penetration by liquid water under a static load. A sample is mounted in a hydrostatic head tester (manufactured by Karl Schroeder KG, of Weinheim, Germany). Water is pumped against one side of the sample until the sample is penetrated by water. The measured hydrostatic pressure is reported in centimeters of water. The test generally follows ASTM D 2724, which is hereby incorporated by reference.

Water transmission was measured on a round sample of material having a diameter of 11 cm that was placed in a hydrostatic head tester with water, at room temperature, against one side of the sample under a hydrostatic head pressure of 1 cm. The time required for 1 liter/$m^2$ of the water to pass through the sample was recorded as the water transmission in seconds.

Pore size distribution was measured on the porous substrate, using a Nachet GLi 154 optical pore size measuring system (manufactured by NACHET of Paris, France), as describing in ASTM F-316-86, which is hereby incorporated by reference.

Surface hardness was measured using a Hammer-Schmidt hardness tester (manufactured by PROCEQ of Zurich, Switzerland), and is reported in HS hardness units.

Air permeability was measured on a 10 $cm^2$ sample according to ASTM D 737, and is reported in $m^3/m^2/min$.

SHEET MATERIALS

The following sheet materials were used in the Comparative Examples reported in Table 1, below, and in the Examples reported in Table 2 below.

Material A: ZEMDRAIN® spunbonded polypropylene sheet having an average thickness of 0.44 mm, a basis weight of 175 $g/m^2$, a tensile strength of 90 N/cm, a water transmission rate of 1800 liters/$m^2$/hr, and a maximum pore size of 50 microns. Material A had an air permeability of 1.8 $m^3/m^2/min$ at a pressure of 98 Pa, 9.3 $m^3/m^2/min$ at a pressure of 500 Pa, and 15.8 $m^3/m^2/min$ at a pressure of 1000 Pa.

Material B: Material A spray coated with 1 $g/m^2$ of G-2109 Hydrophilic Finish from ICI that has been allowed to dry.

Material C: TYVEK® Style 1060B spunbonded polyethylene sheet with an average thickness of 174 microns, a basis weight of about 61 g/m$^2$, and a tensile strength of between 55 and 69 N/cm.

Material D: Material C spray coated with 1 g/m$^2$ of G-2109 Hydrophilic Finish from ICI that has been allowed to dry. Material D had an air permeability of 0.06 m$^3$/m$^2$/min at a pressure of 98 Pa, 0.46 m$^3$/m$^2$/min at a pressure of 500 Pa, and 0.75 m$^3$/m$^2$/min at a pressure of 1000 Pa.

Material E: Material A thermally bonded to 4 mm mesh rectangular net drainage scrim material (TENSAR) having an average fiber diameter of 1.5 mm, 96% open area, an average thickness of 2.2 mm, a basis weight of 380 g/m$^2$, and a compression resistance of 2 MPa for 0.4 mm deformation.

Material F: Material E in which the porous layer (Material A) is spray coated with 1 g/m$^2$ of G-2109 Hydrophilic Finish from ICI that has been allowed to dry.

Material G: Material C thermally bonded to 4 mm mesh rectangular drainage scrim material (TENSAR) having an average fiber diameter net of 1.5 mm, 96% open area, an average thickness of 2.2 mm, a basis weight of 380 g/m$^2$, and a compression resistance of 2 MPa for 0.4 mm deformation.

Material H: Material G in which the membrane layer (Material C) is spray coated with 1 g/m$^2$ of G-2109 Hydrophilic Finish from ICI that has been allowed to dry.

Material I: Material G with a porous layer of Material A thermally bonded to the side of the membrane layer (Material C) opposite the side to which the drainage scrim is bonded.

Material J: Material I in which the porous layer (Material A) is spray coated with 1 g/m$^2$ of G-2109 Hydrophilic Finish from ICI that has been allowed to dry.

Material K: Material J in which the membrane layer (Material C) is independently spray coated with 1 g/m$^2$ of G2109 Hydrophilic Finish from ICI that has been allowed to dry.

COMPARATIVE EXAMPLES 1–9

In each of the following comparative examples, a section of a concrete wall was made using a concrete form lined with one of the various form liner materials listed above. The wall sections were each 20 cm thick and 100 cm high. In comparative examples 1–4, the form liner material was stretched on the concrete form under a tension of about 0.8 kg/cm, in the manner described in U.S. Pat. No. 5,135,692. In comparative examples 5–9, the form liner material was not subjected to independent tensioning, but was instead loosely attached to the inside of the concrete form as described in U.S. Pat. No. 5,302,099. A concrete mix was made by mixing Portland cement, sand, gravel and water in the following proportions:

350 Kg/m$^3$ Portland Cement

655 Kg/m$^3$ Sand

1210 Kg,/m$^3$ Gravel

175 Kg/m$^3$ Water

The concrete mix had a water/concrete ratio of 0.5 (about 0.1 higher than optimum). The concrete mixture was thoroughly mixed and was subsequently poured into the lined concrete form. Air entered the mixture during the mixing and pouring steps. The concrete was vibrated with a 60 mm pocker vibrator at standard conditions for 60 seconds. Following the vibration, the concrete was allowed to set for a period of 24 hours. The water discharged from the concrete form was collected and measured, and the amount collected is reported below.

After the concrete setting period elapsed, the concrete form was removed. The back side of the form was visually inspected to determine whether any concrete particles had passed through the form liner. The liner material was next removed from the concrete. The surface of the concrete was visually inspected for color, air bubbles, and blowholes. The surface hardness of the concrete was also measured. The results of these observations are recorded in Table I below.

TABLE I

| Comparative Example | Liner Material | Water Flow (liters/m$^2$) | Cement Particles Pass to Backside? | Concrete Surface Hardness (HS) | Visual Observations |
|---|---|---|---|---|---|
| 1 | A | 1.0 | Yes | 36–38 | Air, water, and fine cement particles passed through liner. |
| 2 | B | 1.0 | Yes | 36–38 | Water, some air, and fine cement particles passed through liner. Some fine air bubbles remained in the surface of the concrete. |
| 3 | C | 0 | No | 26–28 | No water, air or concrete passed through liner. Concrete had light color with blow holes. |
| 4 | D | 0.6 | No | 32–36 | Excess water and some air passed through liner. Some air was trapped within the liner and blow holes were observed in the surface of the concrete. |
| 5 | E | 1.2 | Yes | 37–39 | Air, water, and fine cement particles passed through liner. |
| 6 | F | 1.2 | Yes | 37–39 | Air, water, and fine cement particles passed through liner. |
| 7 | G | 0 | No | 26–28 | No water, air or concrete passed through liner. Concrete had light color with |

TABLE I-continued

| Comparative Example | Liner Material | Water Flow (liters/m$^2$) | Cement Particles Pass to Backside? | Concrete Surface Hardness (HS) | Visual Observations |
|---|---|---|---|---|---|
| | | | | | blow holes. |
| 8 | H | 1.1 | No | 36–38 | Excess water and some air passed through liner. Some air was trapped within the liner and blow holes were observed in the surface of the concrete. |
| 9 | I | 0 | No | 26–28 | No water, air or concrete passed through liner. Concrete had light color with blow holes. |

EXAMPLES 1–3

In each of the following examples, a section of a concrete wall was sing a concrete form lined with one of the various form liner materials listed above. The wall sections were produced under the same conditions described above for Comparative Examples 5–9. The results are recorded in Table II below.

TABLE II

| Liner Example | Water Flow Material | Cement Particles (liters/m$^2$) | Concrete Surface Pass to Backside? | Visual Hardness (HS) | Observations |
|---|---|---|---|---|---|
| 1 | J | 0.6 | No | 28–30 | On the first use, water passed through the liner while air and cement were trapped inside the liner. Bubbles were observed in the surface of the concrete. |
| 2 | J | 1.2 | No | 37–39 | On the second use (after surfactant was carried into the membrane during the first use), air and water passed through the liner while cement particles were all trapped by the liner. |
| 3 | K | 1.1 | No | 36–39 | Air and water passed through the liner while all cement particles were retained by the liner. |

It is apparent from the above examples that the form liner material of Examples 2 and 3 enhanced the discharge of air and water for a highly fluid concrete mix, while also preventing the passage of fine concrete particles through the form liner. It is also apparent from the comparative examples and the examples that the optimum retention of fine concrete particles without retention of air and excess water was achieved only with a form liner in which all elements of the invention (porous sheet 16 and a hydrophilic microporous membrane 14) were present. Although particular embodiments of the present invention have been described in the foregoing description, it will be understood by those skilled in the art that the invention is capable of modifications, substitutions and rearrangements without departing from the essential attributes of the invention.

I claim:

1. A concrete form liner for lining a concrete form and containing a concrete mixture poured into the concrete form during the manufacture of a concrete article, comprising:

a microporous membrane having pores that transmit at least 1 liter of water per square meter of the membrane during 30 minutes when the water is under a hydrostatic head of 1 cm, but which pores prevent the passage of at least 99% of particles with a diameter larger than 2 microns in water under a hydrostatic head of 150 cm, said microporous membrane having a first side and an opposite second side;

a porous sheet having a first side and an opposite second side, said second side of said porous sheet juxtaposed with said first side of said microporous membrane, said porous sheet having at least one layer of pores 95% of which have a diameter in the range of 0.2 microns to 60 microns, which layer is coextensive with the porous sheet, the air permeability of said porous sheet, measured according to ASTM D 737 at a pressure of 500 Pa, being at least 5 times greater than the air permeability of the microporous membrane, measured according to ASTM D 737 at a pressure of 500 Pa;

wherein said concrete form liner is permeable to air and water in a concrete mixture poured against the first side of said porous sheet, but is substantially impermeable to particles in the concrete mixture of at least 2 microns in diameter.

2. The concrete form liner of claim 1 further comprising a drainage scrim juxtaposed with said second side of said microporous membrane, said drainage scrim increasing the draining effect of the form liner on any excess water present in a concrete mixture poured against the first side of said porous sheet, the drainage scrim having a thickness of at least 1 mm, and an open space of at least 30%.

3. The concrete form liner of claim 1 wherein the microporous membrane prevents the passage of 99% of particles with a diameter larger than 0.3 microns suspended in water under a hydrostatic head of 150 cm.

4. The concrete form liner of claim 3 wherein the microporous membrane is a microporous nonwoven sheet.

5. The concrete form liner of claim 4 wherein said microporous nonwoven sheet is comprised of a hydrophilic polymer material.

6. The concrete form liner of claim 4 wherein said microporous nonwoven sheet is comprised of a polymer material coated with a surfactant.

7. The concrete form liner of claim 6 wherein said microporous nonwoven sheet is comprised of a material selected from the group consisting of bonded meltblown fibers, bonded flash-spun fibers, and microporous films.

8. The concrete form liner of claim 7 wherein said microporous nonwoven sheet is comprised of thermally bonded fibers of flash-spun polyethylene.

9. The concrete form liner of claim 3 wherein at least one side of the porous sheet has a pore size of between 0.2 to 20 microns.

10. The concrete form liner of claim 9 wherein said porous sheet is a layer of porous polymer material applied to the first side of said microporous membrane.

11. The concrete form liner of claim 9 wherein the porous sheet is a woven fabric.

12. The concrete form liner of claim 9 wherein the porous sheet is nonwoven fabric.

13. The concrete form liner of claim 12 wherein the nonwoven fabric is a thermobonded polyolefin sheet material.

14. The concrete form liner of claim 13 wherein the polyolefin is selected from the group consisting of polyethylene and polypropylene.

15. The concrete form liner of claim 1 wherein said porous sheet is laminated to said microporous membrane.

16. The concrete form liner of claim 2 wherein said second side of said porous sheet is attached to said first side of said microporous membrane and said drainage scrim is attached to said second side of said microporous membrane.

17. The concrete form liner of claim 16 wherein the microporous membrane prevents the passage of 99% of particles with a diameter larger than 0.3 microns suspended in water under a hydrostatic head of 150 cm.

* * * * *